US005848935A

United States Patent [19]

Noell et al.

[11] Patent Number: 5,848,935

[45] Date of Patent: Dec. 15, 1998

[54] ROTARY ARCADE GAME APPARATUS AND METHOD

[76] Inventors: Robert E. Noell, 300 Bay St., Ozona, Fla. 34460; Christopher E. Noell, 815 Florida Ave., Palm Harbor, Fla. 34683

[21] Appl. No.: 901,589

[22] Filed: Jul. 28, 1997

[51] Int. Cl.[6] ..... A63F 9/24

[52] U.S. Cl. ..... 463/16; 273/138.2; 273/143 R; 221/121; 221/122

[58] Field of Search ..... 273/138.2, 138.4, 273/138.3, 139, 138.1, 142, 143; 463/16; 221/121, 122, 193, 195, 192, 273, 263, 266, 301

[56] References Cited

U.S. PATENT DOCUMENTS

| | | | |
|---|---|---|---|
| 869,254 | 10/1907 | Munch | 221/122 |
| 1,193,235 | 8/1916 | Chilson et al. | 194/256 |
| 1,842,243 | 1/1932 | Boyer | 221/121 |
| 2,043,166 | 6/1936 | Hart et al. | 273/138.2 |
| 2,101,420 | 12/1937 | Scofield | 221/122 |
| 2,189,641 | 2/1940 | Slezak | 221/184 |
| 2,256,022 | 9/1941 | Gabriel | 221/122 |
| 2,990,084 | 6/1961 | Probasco | 221/11 |
| 3,179,289 | 4/1965 | Moyer et al. | 221/121 |
| 3,807,600 | 4/1974 | Moss et al. | 221/11 |
| 3,970,216 | 7/1976 | Rainey | 221/125 |
| 3,991,907 | 11/1976 | Kull | 221/84 |
| 4,133,525 | 1/1979 | Balles et al. | 273/447 |
| 4,423,828 | 1/1984 | Tanaka et al. | 221/129 |
| 4,913,313 | 4/1990 | Rockola | 221/131 |
| 5,127,544 | 7/1992 | Robinson et al. | 221/93 |
| 5,344,199 | 9/1994 | Carstens et al. | 463/17 |
| 5,402,911 | 4/1995 | Noell | 221/81 |
| 5,553,865 | 9/1996 | Shoemaker, Jr. et al. | 273/448 |

*Primary Examiner*—Benjamin H. Layno
*Attorney, Agent, or Firm*—David Kiewit

[57] ABSTRACT

A merchandise game of chance visually displays a commercially acceptable variety and number of prizes retained in magazines, some of which run along generatrices of a conical rotating body. A second set of magazines is interleaved with the first set of magazines at the base of the body so that prizes in a lower portion of each of the second set of magazines are visible to the player. When a player pushes a button, the rotating body slows to a halt and dispenses a prize if the magazine holding that prize is adjacent a delivery chute. In one version of the game a dummy magazine is used to display the smallest and least valuable prizes. If the dummy magazine is adjacent the chute when the conical surface stops, an equivalent small prize is delivered to the player from a dispensing hopper. The game is housed within a narrow enough enclosure to permit it to be moved through a conventional swinging door.

15 Claims, 5 Drawing Sheets

ROTARY ARCADE GAME APPARATUS AND METHOD

BACKGROUND OF THE INVENTION

1. Field of the Invention

This invention relates to arcade games of skill and chance that display merchandise on a movable surface and dispense the merchandise to a player in response to a winning action.

2. Description of Prior Art

Machines called "merchandisers" or "merchandise games" commonly display multiple items that may be acquired by a player playing a game of skill, chance, or some mixture of skill and chance. Games of this sort are reviewed in the inventor's earlier U.S. Pat. No. 5,402,911, the disclosure of which is herein incorporated by reference. Many of these games display the merchandise (commonly called "prizes") upon a moveable surface (commonly a flat, circular, rotating table) and dispense a prize only if a player manages to sweep it into a delivery chute by moving an arm that is partly controlled by the player's actions and partly controlled by the game itself. A notable drawback of these games is that apparatus configured to display an attractive variety and number of prizes requires a rotary table so large that the game's housing is some four or more feet in width. This makes it difficult to move such a game through a conventional single door entryway to a game parlor, and moreover requires the operator of the game parlor to dedicate a substantial amount of his or her active selling space to that game.

Notable among references in the prior art are:

U.S. Pat. No. 5,553,865, to Shoemaker, Jr., et al.; U.S. Pat. No. 5,127,544 to Robinson et al.; U.S. Pat. No. 4,133,525, to Balles et al.; U.S. Pat. No. 3,807,600 to Moss et al.; U.S. Pat. No. 2,990,084, to Probasco; U.S. Pat. No. 2,256,022 to Gabriel; U.S. Pat. No. 2,043,166 to Hart et al., U.S. Pat. No. 1,193,235 to Chilson et al.; and U.S. Pat. No. 869,254 to Munch; all of which teach various rotary dispensers or merchandisers.

U.S. Pat. No. 5,344,199, to Carstens et al., who show a machine that displays prizes and gives a player a random chance of winning one. Their approach uses a random number generator and matches its output to a number that the player enters on a keypad. The apparatus of Carstens et al. does not involve a moving playing or product display surface, nor is there any element of skill involved.

U.S. Pat. No. 4,913,313, to Rockola discloses a vending machine comprising a plurality of product magazines, wherein each of the magazines provides a tortuous path internal to the machine for the product to move along, thereby increasing the amount of product that can be stored in the machine.

U.S. Pat. No. 4,423,828 to Tanaka et al. teaches a vending machine having a plurality of magazines associated with each vending station.

U.S. Pat. No. 3,991,907, to Kull, shows a vending machine in which knobs selected by the operator are visually linked to a selected dispenser. Kull also shows a mechanical element that provides "one-at-a-time" delivery of products moving from a slanted magazine under the influence of gravity.

U.S. Pat. No. 3,970,216, to Rainey, discloses a dispensing mechanism dispensing a single article from a magazine containing a stacked plurality of articles.

U.S. Pat. No. 2,189,641, to Slezak, teaches a vending machine in which the product (a printed and packaged horoscope) is stored behind a rotating conical surface. Slezak's apparatus does not display the vended product, nor is there any element of chance involved.

Moreover, it is well known in the vending machine arts to display a product or simulacrum thereof at a vending machine and to vend a substitute product perceived by the buyer as being identical to, or at least an acceptable replacement for, the displayed product For example, machines that vend canned beverages from ones of a plurality of refrigerated magazines commonly display a single can of the vended product in an isolated windowed compartment that is at ambient temperature and that may be disposed above a coin slot and a delivery receptacle associated with that product.

SUMMARY OF THE INVENTION

The invention provides a merchandise game that visually displays an acceptable variety and number of items on a moving playing surface, and that is housed within a narrow enough enclosure that the game can be moved through a conventional single-width doorway.

One preferred embodiment of the apparatus for displaying and vending merchandise comprises a generally frusto-conical body rotatable about a vertical axis. The outer surface of this partial cone has a plurality of visible product magazines disposed on it along respective generatrices of the cone so that all the products contained in each of the magazines may be seen from outside the apparatus. There is also a partially hidden product magazine having a lower end at the base of the frusto-conical body and an upper portion internal to the frusto-conical body. Products in the bottom portion of the partially hidden magazine are visible from outside the apparatus, while those higher up in the magazine are hidden from view. Each product is fed by gravity to the lower end of its respective magazine from whence it may be dispensed by a release mechanism when the initially rotating frusto-conical body slows its rotation and stops responsive to a user's command. More specifically, such an embodiment of the invention may be configured with the partially hidden magazine disposed along a generatrix of a second cone that shares the base and axis of the rotating frusto-conical body, but that has a greater apex angle.

In another embodiment the apparatus may comprise a rotating body displaying and dispensing three or more prizes of a differing size and value. This embodiment employs one or more functional magazines as well as a dummy magazine. In the most preferred embodiment the largest magazines are disposed along the frusto-conical surface, as described supra. Other functional magazines holding a product of intermediate size and value are interleaved among ones of the largest magazines and are disposed partially within the rotating body so that only some of the intermediate value prizes are displayed. Relatively short dummy magazines holding and displaying a smallest sized packaged product may be arranged along the base of the rotating conical body so as to largely fill in the space remaining between ones of the two larger magazines and to denote positions along the base of the rotating body at which one of the smallest sized prizes may be won. This embodiment also comprises a separate magazine, which may be visible or may be concealed in the opaque base portion of the apparatus and which is used to dispense a substitute one of the smallest size prizes whenever the body stops its rotation at a position calling for the delivery of one of the smallest prizes—i.e., with the dummy magazine aligned with the delivery chute.

It may be noted that rather than displaying a plurality of the smallest products in dummy magazines, one could equally as well display a single one of them, or could display a picture, a graphic or some other simulacrum of a type of product or package that was to be dispensed from a dispensing means remote from the moveable surface whenever the rotating surface came to a halt with the simulacrum adjacent the delivery chute or other clearly demarcated delivery means.

In a preferred embodiment the apparatus is a game of skill and chance having several (e.g. three) different sizes of magazines with the entirely visible magazines configured to contain larger, more valuable merchandise, and the partially hidden magazines containing smaller packages holding generally less desirable prizes. The user's command to initiate the delivery process, which may be a simple matter of pushing a button subsequent to depositing a coin or token, causes the magazine assembly to slow its rotation in a not quite predictable fashion (e.g., under the influence of a drag brake acting upon a shaft about which it rotates so as to allow the assembly to turn one or two revolutions prior to halting). One of the prizes is delivered when the magazine assembly stops rotating if a portion of a release mechanism associated with its magazine is aligned with a co-acting trip mechanism affixed to a stationary portion of a housing within which the magazine assembly rotates. In one embodiment of the apparatus, the probability that a prize will be delivered on a given play can be enhanced by the deposit of additional coins or tokens. Specifically, this may be done by providing plural trip mechanisms juxtaposed along the circumference of the base of the rotating magazine assembly so that the selection of each additional trip mechanism increases the chance that the release mechanism associated with a desired prize is aligned with an active trip element when the magazine assembly stops.

It is an object of the invention to provide a game of skill and chance displaying a larger number of large attractive prizes than can be conveniently done by a prior art rotating game.

It is a further object of the invention to provide a merchandise game displaying at least as much moving merchandise as a prior art rotary table game, but configured so as to conveniently fit through a standard doorway and to have a minimum footprint on the active selling floor of a game parlor or the like.

It is yet a further object of the invention to provide a merchandise game having visible or audible similarities to the popular prize wheel game in which an initially rotating element slows to a halt while providing visible cues (e.g., lights that flash at a decreasing rate as the wheel slows) or audible cues (e.g., a clicking sound made by a flexible finger adjacent the wheel coacting with a plurality of upstanding pins disposed on the circumference of the wheel) to the player that the wheel is slowing and a prize decision is imminent.

It is an additional object of the invention to provide a dispenser for packaged merchandise, the dispenser comprising a first plurality of product magazines disposed upon a rotating surface and a second plurality of product magazines disposed partially along that surface and partially within that surface. Specifically, it is an object of the invention to provide such a dispenser in which ones of the second plurality of magazines are interleaved among ones of the first plurality of magazines.

DETAILED DESCRIPTION OF THE PREFERRED EMBODIMENT

Figure 1:
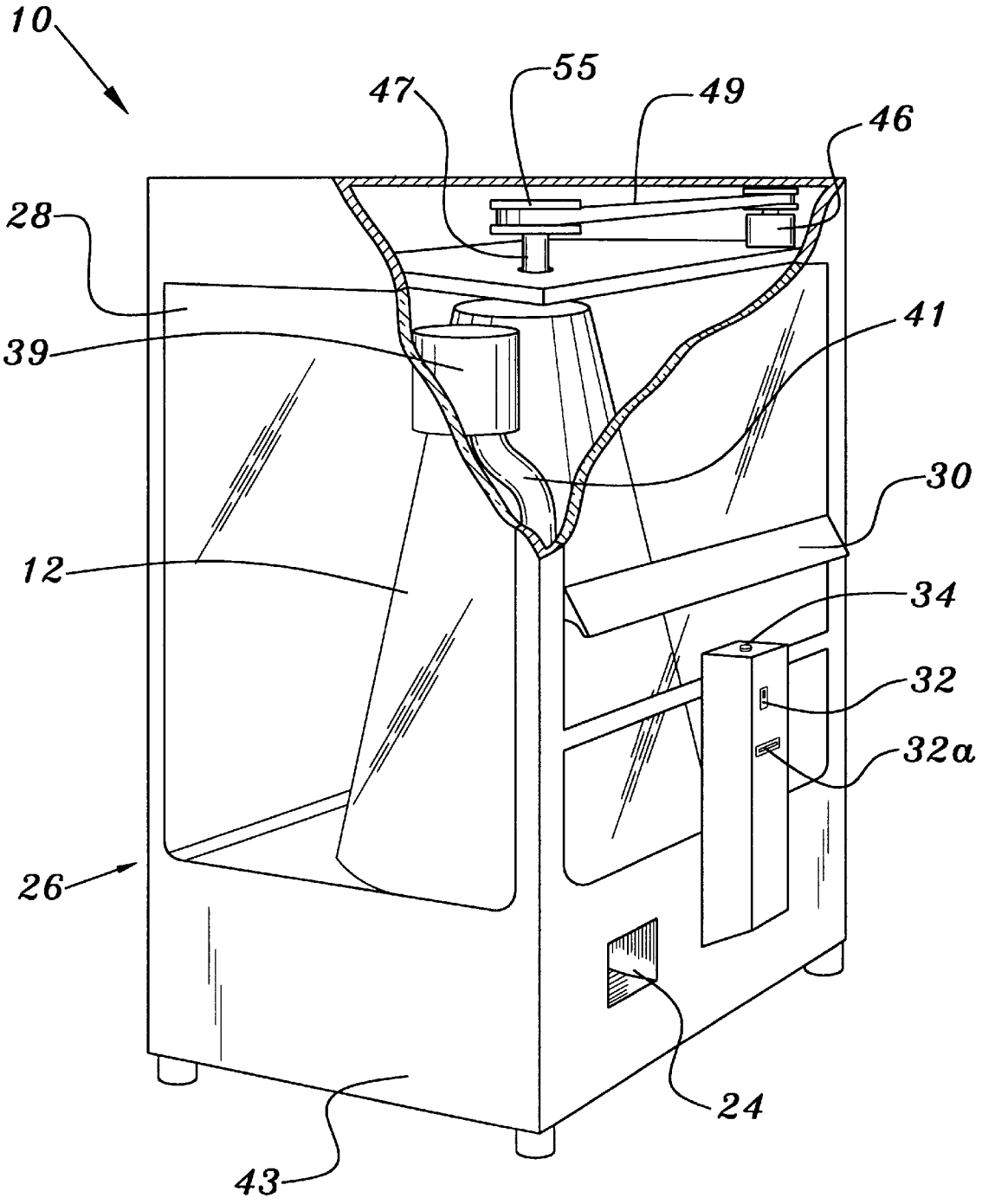
FIG. 1 is a partly cut-away elevational view of a first embodiment of a merchandise game of the invention.

A preferred merchandise game 10 of the invention comprises a generally frusto-conical body 12 on which are disposed a plurality of magazines 14. The conical body 12 is journaled for rotation about a vertical axis 16 and is disposed above a stationary, generally horizontal, surface 18 comprising the upper end of a chute 20. In one embodiment, dispensable articles 22, generally referred to as prizes, are loaded into the magazines 14 and are subsequently fed, under the influence of gravity, to the bottom of the conical body. The bottom-most prize 22 in each magazine may be dispensed by being dropped through the chute 20 to a delivery receptacle 24 at the bottom end thereof. It will be recognized to those skilled in the art that although a frusto-conical shape is preferred, the rotating body 12 could also some other surface of rotation (e.g., a cylinder or a paraboloid).

The game 10 is preferably housed in a housing 26 having transparent window portions 28 that allow the prizes 22 to be seen, but that protect them from casual theft The housing 26 is preferably narrow enough to be conveniently moved into an arcade having a single-width door, and may, for example be two feet wide. The housing 26 may comprise a lighted marquee 30 or other suitable and well-known types of signs intended to attract patrons of a game arcade to the game or to provide playing instructions. Other known approaches for attracting a prospective player's attention to the game, such as providing a combination of bright lights and reflecting elements adjacent the magazines (not shown) may also be employed. In a preferred embodiment, the conical body 12 rotates at a constant speed when the game 10 is not being played and thus displays articles 22 arrayed on its surface.

The product delivery means of the invention are preferably used with a simple game in which a user (not shown) deposits cash or tokens into a known coin mechanism 32 or bill acceptor 32*a* and then pushes a momentary contact switch or button 34 at an instant the user believes to be appropriate for delivering a desired prize 22. The rotating conical body 12 then slows to a stop and delivers a prize 22 from a magazine 14 aligned with the delivery chute 20 if any magazine 14 is so aligned. In a preferred embodiment the slowing of the rotation is accompanied by visible and/or audible signals selected to indicate to the user and to bystanders in the vicinity that the game is being played and that a prize 22 may soon be won. Such signals include things like a repeated clicking sound in which the interval between clicks decreases as the rotating body 12 slows down, flashing lights with a flash rate cued to the rate of rotation, etc. Signals of this sort are well known in the gaming art and have long been generated by mechanical means (e.g., by a flexible braking finger that engages upstanding pins protruding from the circumference of a prize wheel and that generates a clicking noise as the wheel is spun). It is also well known to synthesize such audible or visible cues by electrical or electronic means.

It will be understood to those skilled in the art that the product delivery means of the invention may be used in other settings as well. One could, for example, use the same rotating cone arrangement as a prize delivery mechanism that was actuated at the conclusion of a two-player game to award a prize to the winning player. Such an apparatus would require additional chutes 20 and user controls more complex than a simple momentary contact switch.

The various games with which the apparatus of the invention can be used are generally those comprising elements of both skill and chance. Thus, a game can be configured so that not all plays result in the delivery of prize 22—i.e., if no magazine is aligned with the chute 20. Moreover, the apparatus of the invention provides means to display and dispense prizes having a range of size and value, so that various games using the apparatus may also dispense prizes other than those desired by the player—e.g., the player may be attracted by, and attempt to secure, a large and perceivably valuable prize (e.g., a wallet) but may win a smaller, less valuable prize (e.g., a small rubber scorpion) dispensed from a magazine adjacent the one holding the desired prize.

Figure 2:
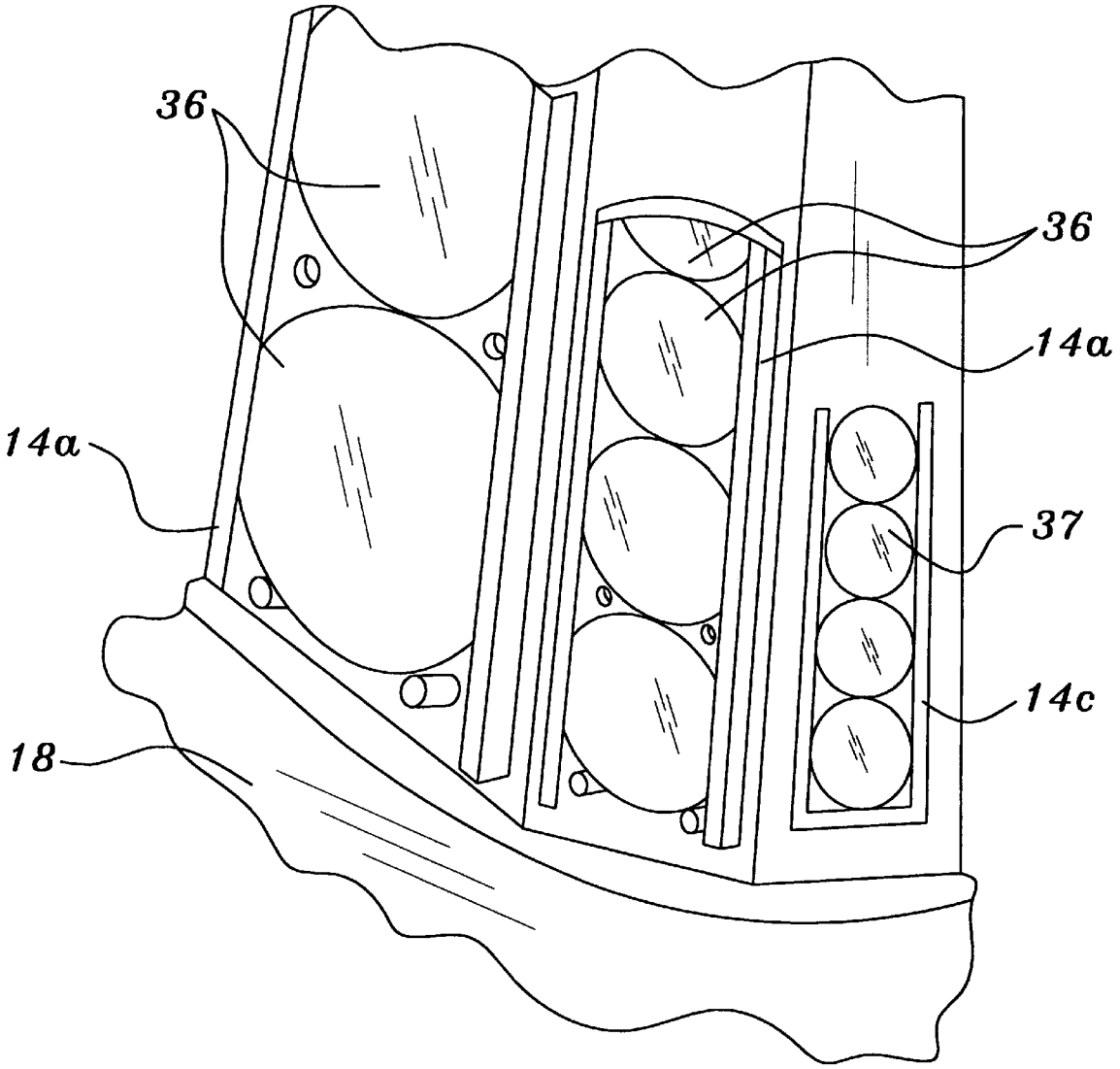
FIG. 2 is a detailed elevational view of a portion of a rotatable frusto-conical body of a merchandise game of the invention in which a faceted conical body is employed.

Preferred embodiments of the invention provide for the storage and display of at least three different sizes of dispensed articles 22. In an embodiment depicted in FIG. 2 the two larger prizes 22*a*, 22*b* (which may be packaged in transparent prize boxes 36) are stored in and delivered from corresponding magazines 14*a*, 14*b* that are at least partially disposed externally to the rotating conical body 12 so as to be visible to a player. Because the large prizes 22*a* are more desirable, the apparatus 10 is preferably configured to display all of the large prizes, and at least the immediately deliverable ones of the medium-sized prizes 22*b*. As is known in the gaming art, small prizes 22*c* may be frequently dispensed to motivate the player to continue depositing finds into a merchandiser. Because winning a particular one of a selection of small prizes 22*c* is not expected to be a player's goal, the apparatus 10 may be configured to display a plurality of small prizes 22*c*, packed in identical, and commonly egg-shaped, containers 37, in one or more dummy magazines 14*c* disposed on the surface of the rotating conical body 12. When the conical body 12 stops with one of the dummy magazines 14*c* aligned with the delivery chute 20, a small prize 22*c* may then be dispensed from a single dispensing hopper 39 which is preferably disposed near the top of the housing 26 (e.g., as depicted in FIG. 1) so that the hopper communicates with the chute 20 by means of a tube 41 through which a small prize may be dropped down the chute 20 from the hopper 39. Alternately, a small prize dispenser 39 may be concealed in an opaque base portion 43 of the enclosure 26 and delivered to the player at the same delivery receptacle 24 provided for the larger prizes 22*a*, 22*b*. Moreover, it will be appreciated by those skilled in the art that instead of employing a dummy magazine 14*c*, one could also employ indicia (e.g., the message "three tickets") disposed on the rotating body and used to denote that one or more fungible prizes were to be dispensed whenever the rotating body 12 stopped with the indicia aligned with the chute.

It may be noted that the selection of the number of magazines of each of the various sizes provides for a gaming apparatus having a desirable overall payout ratio. For example, for each large prize (e.g., a wallet, deliverable from a magazine that is four inches wide), one could provide two medium sized (e.g., a three inch wide magazine) prizes and four small prizes (e.g., a two inch diameter opaque spherical package in a dummy magazine).

Figure 3:
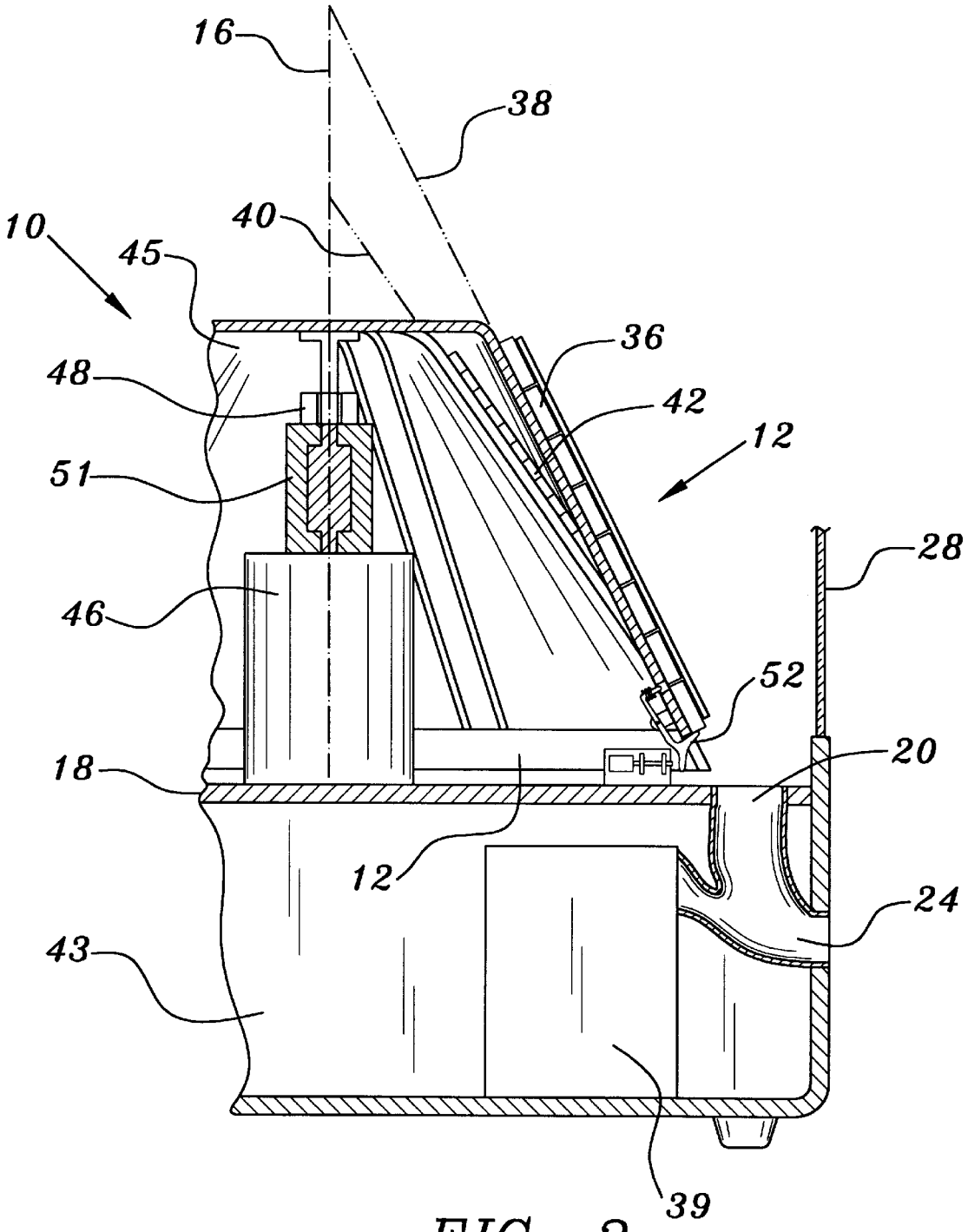
FIG. 3 is a partial vertical cross section of a second embodiment of the merchandise game of the invention, the second embodiment employing magazines disposed along the generatrices of two cones.

The goal of maximizing the display of more valuable prizes is advantageously met by the use of magazines 14 disposed along generatrices of two coaxial cones having a common base but different vertex angles. As depicted in FIG. 3, the axis 38 of a first magazine 14*a* (e.g., one used for the largest prizes 22*a*) is co-linear with the generatrix 38 of a first cone, the first cone providing the external surface of the rotating frusto-conical body 12. The axis 40 of a second magazine 14*b*, holding smaller prizes 22*b*, is co-linear with the generatrix of the second of the two cones so that the second magazine 14*b* has a visible portion at the common base of the two co-axial cones adjacent the delivery chute 20 and so that the second magazine 14*b* has an upper, concealed, portion 42 extending into a hollow interior region 45 of the rotating frusto-conical body 12. The external surface of the rotatable frusto-conical body 12 may have appropriate slots or channels 44 extending inwardly to permit the display of many of the smaller prizes 22*b*. It will be understood that although the magazines 14*a*, 14*b* are depicted in the drawing as being straight, one can easily configure a magazine 14*b* having a hidden portion disposed along a spiral, or other tortuous path, within the rotating body. Thus, the magazine arrangement of the invention provides a vending means in which all the immediately deliverable products are visible in ones of a plurality of magazines having lower ends interleaved along the base of a rotating frusto-conical body 12, and in which all of the products in a first set of magazines are visible.

As depicted in FIG. 3, the body 12 may be supported and driven by an electric motor 46 suitably supported above a table 18 that supports one or more trip mechanisms and that comprises the upper end of the product delivery chute 20. In this version, the motor's shaft 48, which is disposed along the vertical axis 50 of the two cones, may be journaled within a slip clutch 51 that can be controlled by known means to regulate the braking of the frusto-conical body's rotation. In the preferred embodiment, depicted in FIG. 1, the motor 46 is situated near the top of the housing 26 and drives an axle 47 by means a belt and pulleys 55.

Figure 7:
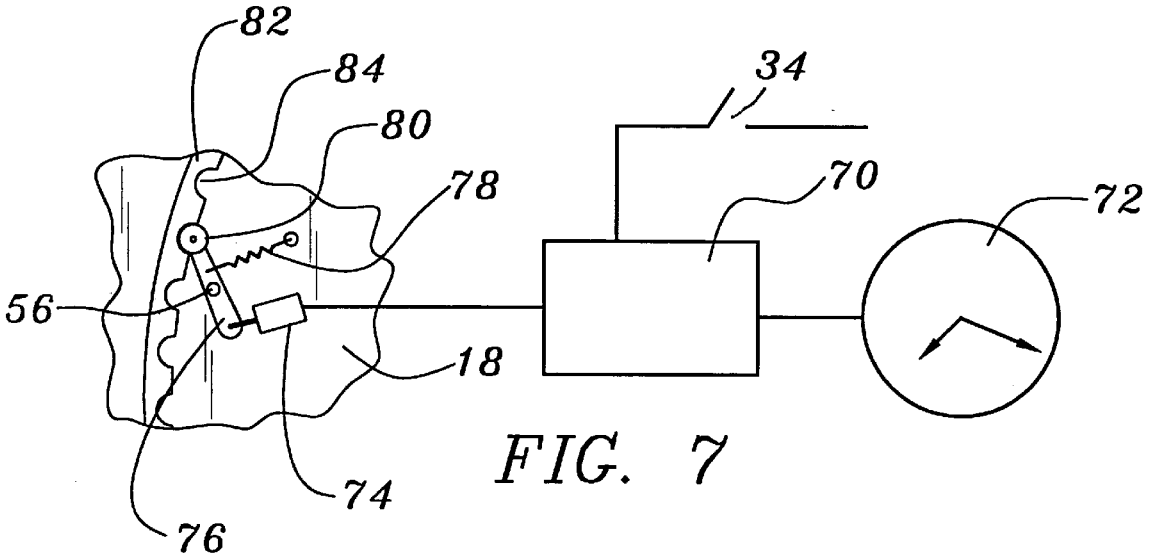
FIG. 7 is cut-away plan view of a braking mechanism for braking the rotation of the rotating body.

In a preferred embodiment, a braking arrangement similar to that depicted in FIG. 7 is employed. In this case the apparatus 10 employs a control means 70, which may comprise any of a variety of known microprocessor-based circuits, having inputs from both a timekeeping means 72 and from the user's control button 34. When the user actuates the control button 34, the preferred control means 70 waits a predetermined interval determined with reference to the timekeeping means 72 and then actuates a solenoid 74, holding the solenoid in its actuated position for a second interval. The solenoid 74 moves a pivoted arm 76 against the force of a bias spring 78 that normally holds a roller 80 (rotatably attached to the arm 76 at the end distal from the solenoid) out of contact with a braking wheel 82. Thus, when the solenoid is actuated the roller 80 is brought into contact with the braking wheel 82 (which is fixedly attached to the rotating body 12), causing the wheel and the attached body 12 to come to a halt. In a preferred embodiment the solenoid force and bias spring strength are selected so that after the roller 80 initially engages the wheel 82, it rolls into and out of two or three adjacent semi-circular pockets 84 before the associated frictional forces bring the rotating body to a halt. Alternately, one could configure a game in which the stopping time of the rotating conical magazine array is fixed and in which the player has some control over the braking rate—e.g., the player may have control over a brake as the rotating cone slows from its initial regulated speed to a second regulated speed, with the cone slowing from the second regulated speed to a halt under automatic control.

Figure 4:
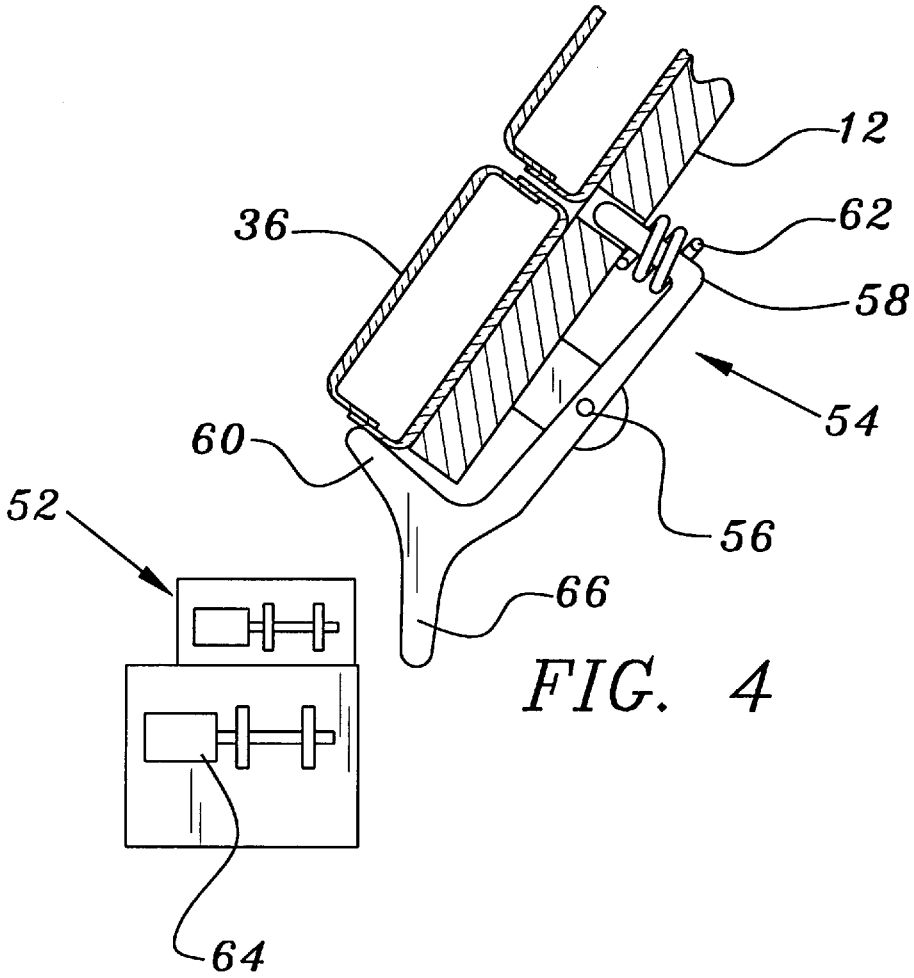
FIG. 4 is a cross-sectional view of the apparatus taken in a plane that includes the axis of rotation, the view depicting a product release mechanism portion of one embodiment of the invention.

Many different product delivery means can be used to deliver a single article from the bottom of a magazine 14 aligned with a chute 20. One such arrangement is depicted in FIG. 4. This comprises a tripper portion 52 affixed to the stationary table 18 and co-acting with treadle 54 disposed on the rotating frusto-conical body 12. The treadle 54 comprises a pivotal mounting 56 attaching it to the inner surface of the frusto-conical body 12 and further comprises upper 58 and lower 60 fingers that act to prohibit a prize 22 from sliding down the magazine 14. In a normal resting position, a bias spring 62 holds the lower finger (or, preferably, pair of fingers) 58 beneath the prize 22 at the bottom of the magazine 14. In the vending operation, a portion of the tripper 52 (which may be a solenoid plunger 64 or another suitable electromechanical actuating element) is driven into a target portion 66 of the treadle 54, causing the treadle 54 to pivot about its mounting 56 so that the upper finger or fingers 58 are driven between the lowest and the second lowest prizes in the magazine, while the lower finger or fingers 60 are pushed away from the leading edge of the lowest prize, thus allowing the lowest prize in the magazine to fall into the chute while simultaneously prohibiting additional prizes in that magazine from moving downwards. When the tripper 52 returns to its normal resting position, the treadle 54 pivots back into its normal resting position, which allows the remaining prizes in the magazine to slide downwards.

Figure 5:
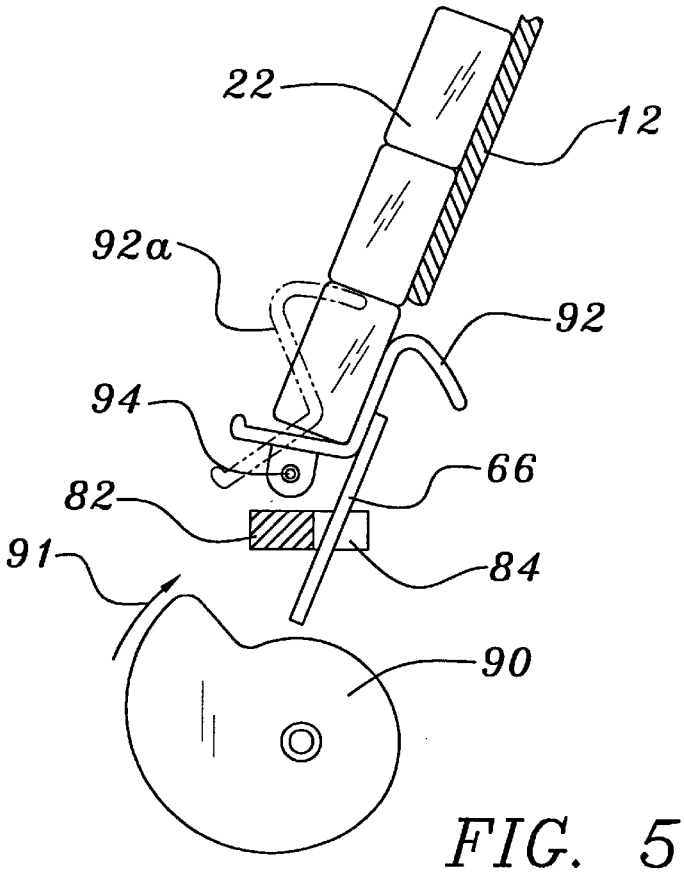
FIG. 5 is a cross-sectional view, similar to that of FIG. 4, of an alternate product release mechanism.

A preferred product delivery means used with the apparatus of the invention is depicted in FIG. 5. Here a cammed wheel 90 is rotated through a single revolution by an electric motor (not shown) whenever the rotating body 12 comes to a halt If the rotatable body halts with a magazine in a delivery position, the cammed wheel 90 rotates in the direction indicated with the bold arrow 91, strikes a cooperating target portion 66 of a pivotable retainer 92 and causes the retainer to rotate about its pivotable 94 mounting into a dispensing position (indicated in phantom in FIG. 5 as 92*a*).

It will be understood to those skilled in the art that the width of the target 66, as measured along the circumference of the base of the cone, can be selected so as to control the probability that a product is delivered on a given play. Moreover, it is clear that the widths of the targets associated with different ones of the magazines need not be proportional to the widths of the respective magazines. That is, one could configure a game having wide targets associated with the narrower magazines and relatively narrow targets associated with the wider magazines so as to ensure a greater frequency of delivery of less valuable prizes and a concomitant lesser frequency of delivery of the more valuable ones.

Figure 6:
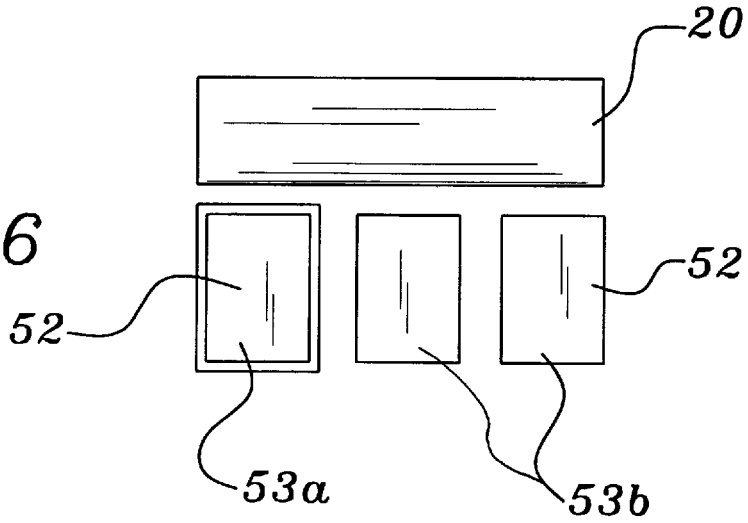
FIG. 6 is a plan view of a multi-element trip mechanism comprising a plurality of fingers selectable by a user of the apparatus.

The tripper 52 can be chosen to operate either inside (e.g., as depicted in FIG. 3) or outside (e.g., as depicted in FIG. 4) the rotating conical body 12. In one embodiment of the invention, as depicted in FIG. 6, a plurality of trippers 52 is used, and the top of each tripper is visible on the table 18 outside of the rotating frusto-conical body 12. Moreover, each of these trippers 52 can be moved vertically between a raised position (shown as 53*a* in FIG. 6), in which it is active, and a lowered position (shown as 53*b* in FIG. 6) in which it is prohibited from striking the target 66. In this arrangement the user may play the game with a single tripper, or, by depositing an additional amount of money or tokens, may increase the number of active trippers and thereby increase his or her probability of winning a prize on a single play.

In embodiments of the apparatus 10 having a bulk dispensing mechanism 39 for small, interchangeable prizes 22*c*, it will be understood that the motion of the tripper 52 does not directly cause delivery of the prize 22*c*. Rather, actuation of the tipper 52 may close a momentary contact switch (not shown) associated with the dummy magazine 14*c* and disposed in a position corresponding to that of the target portion 66 of the treadle 54 associated with a large magazine 14*a*, 14*b*. Alternately, one could choose to determine the angular position of the shaft 48 with a known shaft encoder (not shown) and to then dispense a small prize from the concealed dispenser 37 whenever the rotating cone 12 stopped at one of a predetermined plurality of positions in which one of a corresponding plurality of dummy magazines 14*c* was aligned with the delivery chute 20.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

We claim:

1. In a merchandise game of chance having a moveable surface, the game comprising means for dispensing a prize disposed on the movable surface into a delivery means, an improvement wherein the movable surface comprises an external surface of a body having an interior region, the body journalled for rotation about a vertical axis, a base of the body adjacent the delivery means; and wherein a first plurality of prizes having a first size are disposed in a visible magazine disposed along the moveable surface, and a second plurality of prizes having a second size are disposed in a partially visible magazine having a lower portion adjacent the base of the body and an upper portion disposed interior thereto.

2. The merchandise game of claim 1 wherein the body comprises a frusto-conical body and wherein the partially visible magazine has an axis disposed along a generatrix of a cone having a common base with the frusto-conical body, the cone having an apical angle more obtuse than that of the frusto-conical body.

3. The merchandise game of claim 1 wherein the first size is larger than the second size.

4. The merchandise game of claim 1 wherein the body comprises a frustum of a faceted cone.

5. The merchandise game of claim 1 further comprising a dummy magazine disposed on the moveable surface, the dummy magazine holding a third plurality of prizes having a third size; and a dispenser for dispensing one of a fourth plurality of prizes having the third size, the dispenser not disposed on the moveable surface.

6. The merchandise game of claim 1 wherein the delivery means comprises a visible product delivery means adjacent the base of the body, the visible product delivery means delivering a single prize disposed in either the first or the second magazines to a delivery chute portion of the delivery means.

7. The merchandise game of claim 1 wherein the body, when rotating about the vertical axis, slows to a halt responsive to a player's action and the prize is thereafter dispensed only if one of the magazines is aligned with a delivery chute portion of the dispensing means.

8. A method of operating a merchandise game of chance having a moveable surface, the game dispensing a prize into a delivery chute responsive to a player's action, the method comprising the steps of:

a) loading into each of a plurality of magazines disposed on an external surface of a body journaled for rotation about a vertical axis a respective plurality of the prizes;

b) causing the body to rotate about the axis until the occurrence of the player's action;

c) slowing the rotating body to a halt d) actuating a product delivery means acting to dispense the bottom-most prize in one of the magazines only if that magazine is aligned with the delivery chute.

9. The method of claim 8 wherein a portion of the product delivery means is visible to the player.

10. The method of claim 8 wherein the player's action comprises the steps of a) inserting an amount of money into the game; and b) closing a momentary contact electric switch; and wherein the game further comprises a plurality of the product delivery means and wherein a predetermined number of the product delivery means are actuated simultaneously, the number responsive to the amount of money.

11. A merchandise game comprising a moveable surface and a delivery means for delivering a product to a user, the game comprising:

a functional vertically mounted magazine for retaining a first plurality of the products on the moveable surface so that all of the first plurality of products disposed in the functional magazine are visible to the user, and for dispensing a bottom-most one of the first plurality of products into the delivery means only if the functional magazine is adjacent the delivery means;

a simulacrum of one of a second plurality of products, the simulacrum disposed on the moveable surface so that the simulacrum is visible to the user; and dispensing means for retaining the second plurality of products, the dispensing means adapted to dispense one of the second plurality of products to the delivery means only if the simulacrum is adjacent the delivery means.

12. The merchandise game of claim 11 comprising a housing having transparent portion and an opaque portion wherein the dispensing means is concealed.

13. The merchandise game of claim 11 comprising a housing having transparent portion and an opaque portion and wherein the dispensing means is disposed within the transparent portion.

14. The merchandise game of claim 11 wherein each of the second plurality of products is disposed within one of a third plurality of identical containers and wherein the simulacrum comprises one of the identical containers.

15. The merchandise game of claim 11 wherein the simulacrum comprises an indicium disposed on the moveable surface.

* * * * *